US005846483A

United States Patent [19]

Venugopalan et al.

[11] Patent Number: 5,846,483

[45] Date of Patent: Dec. 8, 1998

[54] SELENIZED DAIRY SE-NI-SN-ZN-CU METAL

[75] Inventors: Devarajan Venugopalan, Franklin; Sudhari Sahu, Glendale, both of Wis.

[73] Assignee: Creative Technical Solutions, Incorporated, Glendale, Wis.

[21] Appl. No.: 792,781

[22] Filed: Feb. 3, 1997

[51] Int. Cl.[6] ..... C22C 9/02

[52] U.S. Cl. ..... 420/473; 420/476; 420/481; 420/473

[58] Field of Search ..... 420/473, 476, 420/481, 485

[56] References Cited

U.S. PATENT DOCUMENTS

| | | | |
|---|---|---|---|
| 2,743,176 | 4/1956 | Thomas et al. | 75/171 |
| 4,702,887 | 10/1987 | Larson | 420/442 |
| 4,879,094 | 11/1989 | Rushton | 420/476 |
| 5,242,657 | 9/1993 | Sahu | 420/473 |
| 5,330,712 | 7/1994 | Singh | 420/472 |
| 5,413,756 | 5/1995 | Sahu | 420/481 |
| 5,487,867 | 1/1996 | Singh | 420/471 |
| 5,614,038 | 3/1997 | King et al. | 148/538 |

FOREIGN PATENT DOCUMENTS 53-026719 3/1978 Japan .

OTHER PUBLICATIONS

Cyril S. Smith, Copper Alloys Containing Sulphur, Selenium and Tellurium, Oct. 1937 AIME pp. 325–336 Atlantic City Meeting.

L. V. Whiting et al., Mod. Red Brass with Bismuth a literature review and analysis, Apr. 1995, American Foundrymen's Soc.

D. L. Twarog, Mod. Red Brass with Bismuth and selenium research results., Apr. 1995, American Foundrymen's Soc.

L. V. Whiting et al, The Casting Characteristics of Red Brass Containing Bismuth and Selenium, 1994, CANMET, AFS Contract No. BI–1 MTL 94–30(OP–J).

Sebiloy II (Low–Lead Red Brass Casting Alloy), Jul. 1996, Alloy Digest.

New Range of Nontoxic Free–Machining Copper & Brass Alloys with Bismuth, 1995, Bulletin of the Bismuth Institute.

Water Leach Testing of Pb–Free Free–Machining Copper Alloys Containing Selenium and Bismuth by Douglas Hayduk and Abbas Mizra, Jun. 1993 issue of the Bulletin of Selenium–Tellurium Development Association, Inc.

*Primary Examiner*—Sikyin Ip

*Attorney, Agent, or Firm*—Dorn, McEachran, Jambor & Keating

[57] ABSTRACT

Selenium bearing copper-nickel, corrosion resistant and gall resistant castable alloy, particularly for food processing machine parts, with the following weight percentage range:

Ni=10–40

Zn=2–6

Sn=2–7

Se=1–4

Bi=0–3

Fe=0–3

P=0–0.2

Cu=Balance

10 Claims, 4 Drawing Sheets

SELENIZED DAIRY SE-NI-SN-ZN-CU METAL

BACKGROUND OF THE INVENTION

This invention relates to a selenium bearing, corrosion resistant copper-nickel alloy especially suited for use in food processing equipment. This non-galling alloy may be continuously or statically cast into different shapes.

Dairy Metals, which are also known as "Dairy Bronzes", "German Silvers", and "Nickel Silvers" are copper-nickel alloys containing varying amounts of tin, zinc, and lead. Lead has been an essential ingredient for these alloys because non-galling characteristics of these alloys depend on it. Lead also gives enhanced machinability to these alloys. Typically, lead content of Dairy Metals ranges between 2 and 6 percent by weight.

During the past twenty-five years it has been established that ingestion of even a few parts per billion of lead into the human body leads to severe health problems. Children are especially affected by lead intake. As a result, special efforts have been made to eliminate lead from materials which might end up in the human body. An example of this effort will be the elimination of lead in water goods like sink faucets. Equipment certifying agencies like the National Sanity Foundation (NSF) and Dairy and Food Industries Suppliers Association (DFISA) have already established the policy that, henceforth, they will not accept any lead bearing materials in contact with comestibles.

Bismuth has been a popular element to replace lead in non-galling alloys. Nickel-base alloys of Thomas and Williams, U.S. Pat. No. 2,743,176 and Larson, U.S. Pat. No. 4,702,887 are examples of alloys where bismuth has been used as a lubricating and machinability enhancing element. These alloys are in current use. However, these alloys are very expensive. Also in applications like scraper blades where a sharp edge of this metal rubs against stainless steel, this alloy leads to galling. High strain hardening coefficient coupled with poor thermal conductivity of those nickel base alloys and stainless steels lead to generation and retaining of heat at metal contact surfaces during operation of the equipment. These possibly lead to loss of Bi from the rubbing edge and to consequent galling.

More recently, Bi has been used to replace Pb in dairy metals (Sahu; U.S. Pat. No. 5,242,657). This alloy has good corrosion and anti-galling characteristics which makes it extremely well suitable for many applications, but without the high strength and ductility needed for applications such as scraper blades and similar devices.

Therefore, the objective of this invention is to provide a moderate cost alloy with good corrosion and anti-galling characteristics coupled with high strength and ductility.

SUMMARY OF THE INVENTION

The preferred analysis of our alloy is as follows:

| Element | Weight Percent |
|---|---|
| Copper | Balance |
| Tin | 4 |
| Zinc | 4 |
| Nickel | 22 |
| Selenium | 2 |

Variation in the above chemistry is possible and a satisfactory alloy can have the following chemical ranges:

| Element | Weight Percent |
|---|---|
| Copper | Balance |
| Tin | 2–7 |
| Zinc | 2–6 |
| Nickel | 10–40 |
| Selenium | 1–4 |
| Bismuth | 0–3 |
| Iron | 0–3 |
| Phosphorus | 0–0.2 |

This alloy may contain small amounts of C, Si, Mn, Al, Ti and other elements as incidental or trace elements. There are several copper base alloys in use which contain up to 9% bismuth; e.g. U.S. Pat. Nos. 4,879,094 (Rushton); 5,242,657 (Sahu); 5,330,712 (Singh); and 5,413,756 (Sahu). As such, bismuth may be present in many scrap sources used for the melt and can be tolerated in amounts to about 3% by weight. The same is true for iron which may come from scrap contaminated with steel or iron pieces.

When the ingredients are mixed in approximately the preferred analysis, the following physical properties are obtained:

| | |
|---|---|
| Tensile Strength | 40–55 KSI |
| Yield Strength | 28–35 KSI |
| Percent Elongation | 5–10% |
| Hardness | 110–140 BHN |

BRIEF DESCRIPTIONS OF THE ILLUSTRATIONS

DESCRIPTION OF THE PREFERRED EMBODIMENTS

The alloy of the present invention can be melted in a gas fired crucible or an induction furnace. Zinc is charged at the bottom of the melting vessel followed by nickel and copper. Tin is added to the partially molten charge and goes into solution readily. When the charge is completely molten, the slag on top of melt is skimmed off completely. At this point, selenium is added to the melt in the form of copper-selenide or pure selenium. Finally, the melt is deoxidized with phos-copper and transferred into a pouring vessel. The molten metal is poured into static molds to cast parts of desired shape and size. The molten metal can also be poured into heated tundish for continuous casting of different products. This metal can also be centrifugally cast. The chemistry of four induction melted heats melted by the above process is given in Table 1.

TABLE 1

| Chemistry of Selenized Dairy Metal (Percent by Weight) | | | | | | | | | |
|---|---|---|---|---|---|---|---|---|---|
| Alloy ID | Cu | Ni | Sn | Zn | Fe | Se | Bi | P | Ti |
| 55K | Balance | 21.74 | 4.79 | 3.20 | .86 | 2.37 | — | .11 | .03 |
| 85M1 | Balance | 21.83 | 4.64 | 3.74 | .87 | 1.22 | .01 | .12 | .08 |
| 85M2 | Balance | 20.51 | 4.26 | 2.85 | 1.60 | 1.58 | 1.74 | .05 | .08 |
| 66M | Balance | 21.20 | 4.49 | 5.13 | .83 | 2.62 | — | .06 | .05 |

Mechanical properties of above alloys are given in Table 2.

TABLE 2

| Alloy ID | Tensile Strengths KSI | Yield Strength KSI | % Elongation in 2 inches | Hardness BHN |
|---|---|---|---|---|
| 55K | 45.0 | 30.5 | 8.0 | 126 |
| 85M1 | 46.0 | 32.1 | 10.0 | 120 |
| 85M2 | 41.5 | 29.0 | 5.5 | 139 |
| 66M | 49.6 | 34.5 | 8.5 | 131 |

It is important to note here that the present alloy has twice as much strength as that of Sahu, U.S. Pat. No. 5,242,657 (Column 2, lines 59 to 65). What is even more important is that the present alloy has three times as much elongation as that of Sahu's. Combination of high strength and high elongation makes the present alloy suitable for applications like scraper blades.

FRICTION PROPERTIES

Anti-galling alloys must necessarily have a low coefficient of friction in rubbing contact in marginally lubricated condition. To evaluate this, testing was done according to modified ASTM D3702 method. Rings of present alloy were run against 316 stainless steel washers at room temperature in distilled water. Coefficients of friction (C.O.F.) were measured for given PV values and are plotted in FIG. 1. Pressure P was measured in pounds per square inch and velocity was measured in feet per minute. Higher PV value means a higher intensity of loading. For comparison purposes, the alloy of U.S. Pat. No. 5,242,657 has been included as a broken line.

Figure 1:
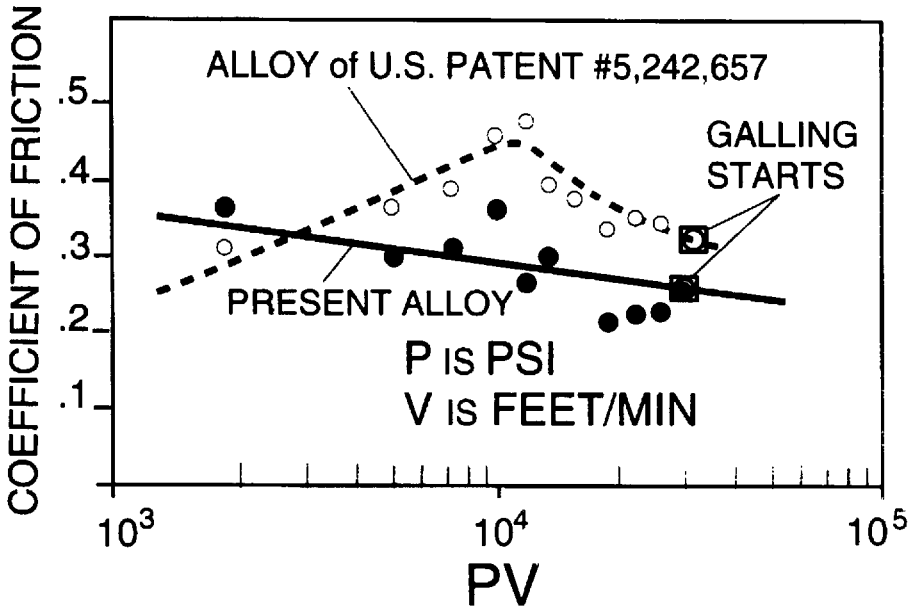
FIG. 1 is a graph showing the variation of coefficient of friction with the severity of loading represented by the product function PV.

It can be seen from FIG. 1 that the present alloy has a very low coefficient of friction. Average C.O.F. between PV=2500 and PV=20000 for the present alloy is 0.28 compared to C.O.F. of 0.35 for the alloy of U.S. Pat. No. 5,242,657. This is significant because lower coefficient of friction results in lower power requirements for running of machinery.

CORROSION RESISTANCE

Alloys used in food contact must have adequate corrosion resistance to chemicals in the food as well as cleaning and sanitizing compounds. Poor corrosion resistance will lead to product contamination as well as difficulties in sanitizing and possible bacterial growth. The following compounds were selected to run the corrosion test.

1. Five weight percent of sodium hydroxide in water.
2. Stera-Sheen: This is a cleaning and sanitizing formula sold by Purdy Products Company of Wauconda, Ill. One ounce of powder per gallon of water gave a 100 ppm available chlorine.
3. Cloverleaf CLF-3300: This is a concentrated cleaning compound marked by Cloverleaf Chemical Company of Bourbonals, Ill. The solution was prepared by mixing one ounce of this cleanser with one gallon of water. This solution had 220 ppm chlorine ion in it.

The corrosion test was run per ASTM specification G31-72. The specimen was in the form of a disc with nominal OD=1.250", ID=0.375" and thickness=0.187". Properly prepared specimens were weighed and their dimensions measured. The sample was put inside a one liter solution of one of the above compounds. The solution was kept at 150° F. and magnetically stirred. The specimen was kept in the solution for 72 hours. At the end of this period the specimen was taken out, washed, dried and re-weighed. From the weight difference and dimensions of the specimen the corrosion rate in mils per year was computed. Two specimens were tested for each condition and the average of two readings are reported here (Table 3).

TABLE 3

| Corrosion Rate in Mils Per Year | | |
|---|---|---|
| NaOH | Stera-Sheen | Cloverleaf CLF-3300 |
| 3.04 | 3.95 | 3.30 |

In general, a corrosion rate of 10 mils per year or less is considered perfectly acceptable. On this basis, the present alloy has very good corrosion resistance.

Figure 2:
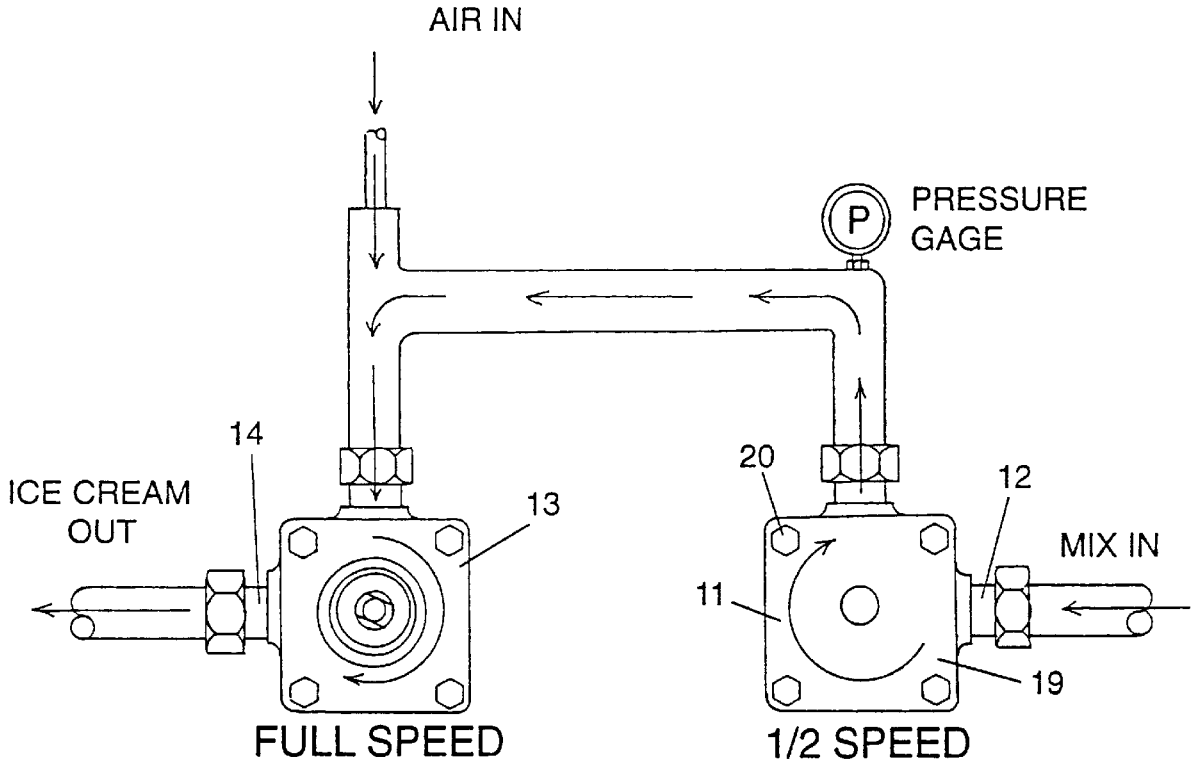
FIG. 2 shows a product mix pump in which parts made with the alloy of present invention may be embodied.
Figure 2A:
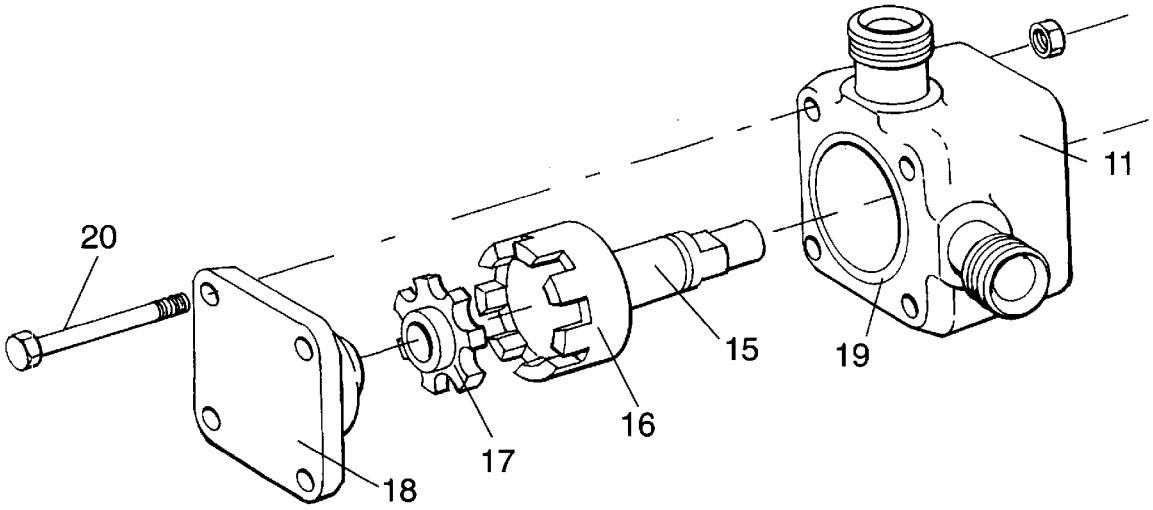
FIG. 2A is an exploded view of a product mix pump of the type shown in FIG. 2 of the drawings.
Figure 3:
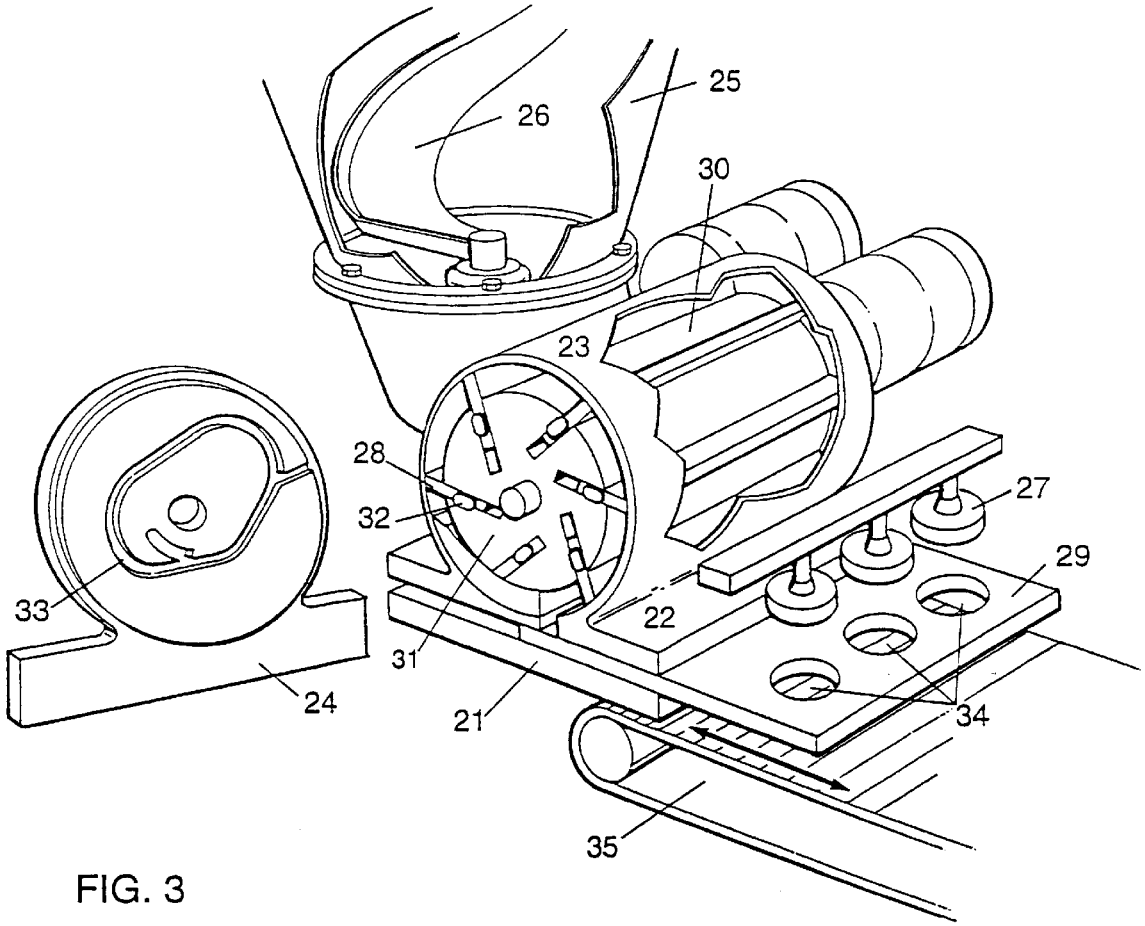
FIG. 3 shows a portion of food forming machine in which parts made with the alloy of present invention may be embodied.

Two typical pieces of equipment where the present alloy may be incorporated are shown in FIGS. 2, 2A and 3. FIG. 2 shows a product mix pump arrangement for ice cream and air mix. The drive shaft 15, rotor 16, idler 17 and pump head 18 shown in FIG. 2A may be manufactured out of present alloy, either static or continuously cast. The pump housing 19 and the studs 20 may be made out of stainless steel either cast or wrought During operation, ice cream ingredients are metered into the gear pump 11 through inlet 12. This pump runs at approximately one half the speed of another identical pump 13. The latter pump mixes air and the product, and the ice cream exits through the outlet 14 in a smooth and nicely textured form.

FIG. 3 shows a portion of the food shaping machine. The bottom plate 21, top plate 22, pump housing 23, cover plate 24, hopper 25, spiral 26 and knock-out punch 27 may be made out of stainless steel, either cast or wrought The scraper blades (vanes) 28 and the mold plate 29 may be made out of the present alloy, either statically cast or continuously cast. During operation, intermittent rotation of the spiral 26 gently pushes the product into vane style pump 30. The product is then conveyed by the rotor 31 until the leading vane 28 is retracted. This is accomplished by blade end guides 32 following the guide groove 33 in the end plates 24. Once the vane is retracted, the product under pressure flows into the mold plate cavities 34 at the appropriate time. The mold plate is then moved out to knock out position at which time the portion is knocked out onto a conveyor belt 35 by the knockout punch 27. The mold plate then retracts into original position and the process repeats again.

We claim:

1. A selenium bearing copper-nickel, corrosion resistant and low friction cast alloy, consisting essentially of in weight percentage:

Ni=22

Sn=4

Zn=4

Se=2

Cu=Balance, Substantially.

2. A cast lead-free copper-nickel dairy bronze alloy consisting essentially in weight percentage range:

Ni=10–40

Sn=2–7

Zn=2–6

Se=1.22–4

Bi=0–3

Fe=0–3

P=0–0.2

Cu=Balance, Substantially.

3. In a food processing machine in which opposed members are in contact with one another, at least one of the said members being fabricated of an alloy according to claim 1.

4. In a food processing machine in which opposed members are in contact with one another, one of the opposed members is fabricated of an alloy according to claim 1 and the other is made of stainless steel.

5. In a food processing machine in which opposed members are in contact with one anther, at least one of the said members being fabricated of an alloy according to claim 2.

6. In a food processing machine in which opposed members are in contact with one another, one of the said members being fabricated of an alloy according to claim 2 and the other member being made of stainless steel.

7. In an ice cream mix machine in which opposed members are pump housing and a rotor, the said rotor being fabricated of an alloy according to claim 1.

8. In a food forming machine in which opposed members are scraper blades and a pump housing, the said scraper blades being fabricated of an alloy according to claim 1.

9. In an ice cream mix machine in which opposed members are pump housing and a rotor, the said rotor being fabricated of an alloy according to claim 2.

10. In a food forming machine in which opposed members are scraper blades and a pump housing, the said scraper blades being fabricated of an alloy according to claim 2.

* * * * *